US008671923B2

(12) United States Patent
Goff et al.

(10) Patent No.: US 8,671,923 B2
(45) Date of Patent: Mar. 18, 2014

(54) STOCK AND TRIGGER ASSEMBLY FOR CROSSBOW

(76) Inventors: Jerry Goff, Saucier, MS (US); Sherwood L. Goff, Saucier, MS (US)

( * ) Notice: Subject to any disclaimer, the term of this patent is extended or adjusted under 35 U.S.C. 154(b) by 11 days.

(21) Appl. No.: 13/560,380

(22) Filed: Jul. 27, 2012

(65) Prior Publication Data

US 2012/0304974 A1 Dec. 6, 2012

Related U.S. Application Data

(63) Continuation-in-part of application No. 13/117,666, filed on May 27, 2011.

(60) Provisional application No. 61/354,818, filed on Jun. 15, 2010.

(51) Int. Cl.
*F41B 5/12* (2006.01)

(52) U.S. Cl.
USPC ..... 124/25

(58) Field of Classification Search
USPC ..... 124/25, 35.2
See application file for complete search history.

(56) References Cited

U.S. PATENT DOCUMENTS

| | | | | |
|---|---|---|---|---|
| 4,827,893 | A * | 5/1989 | Nishioka | 124/25 |
| 5,215,069 | A * | 6/1993 | Liu | 124/25 |
| 7,770,567 | B1 * | 8/2010 | Yehle | 124/25 |
| 7,836,871 | B2 * | 11/2010 | Kempf | 124/25 |
| 8,104,461 | B2 * | 1/2012 | Kempf | 124/25 |
| 2009/0194086 | A1 * | 8/2009 | Kempf | 124/25 |

* cited by examiner

*Primary Examiner* — John Ricci
(74) *Attorney, Agent, or Firm* — Drinker Biddle & Reath LLP

(57) ABSTRACT

A kit for converting a compound bow into an inline crossbow includes a draw-lock bar with a mechanism to attach the bow to one end. Near the other end of the draw-lock bar is a trigger assembly that attaches to one side of the bar and a string latch and release assembly that attaches to an opposite side of the bar. The trigger assembly and the latch/release assembly—can be attached on either side of the bar such that the bow is configured for left or right hand shooting. The trigger assembly is attached to the bar well forward of the latch/release assembly, and an actuator rod that passes inside of the draw-lock bar connects the trigger with the string latch/release. A sliding cover over the string latch prevents the released bow string from stinging the archer's cheek.

16 Claims, 13 Drawing Sheets

STOCK AND TRIGGER ASSEMBLY FOR CROSSBOW

CROSS REFERENCE TO RELATED APPLICATIONS

This application is a continuation-in-part of prior application Ser. No. 13/117,666, which was filed on May 27, 2011, and which claims the benefit of US Provisional Patent Application No. 61/354,818 filed on Jun. 15, 2010.

BACKGROUND OF THE INVENTION

This invention relates to the general classification of archery bows, and more specifically to bows with draw-lock and release mechanisms. The new matter relates to improvements in the trigger and string release assemblies, and to an improved butt stock. For the purpose of continuity and ease of reference, the background of the invention found in the patent application is repeated in the following paragraphs.

Bow hunters strive for high speed/flat trajectory and deep penetration energy when using either compound bows or traditional crossbows, but each type of bow produces its arrow's flight energy in a different manner. A compound bow typically has a lower maximum draw weight (e.g., 50-80 lbs, with a 50% or greater drop-off at full draw), but a longer power stroke (e.g. 18-24 inches) than the crossbow—which by comparison typically has a high draw weight (150-225 lbs) but a short power stroke (10-14 inches). These differences produce commensurate differences in arrow/bolt speed and penetration. For example, a 70 lb pull compound bow will typically launch an arrow at a higher velocity than a 150 lb crossbow does with its shorter and lighter bolt.

Power stroke is the distance the bow string travels from full draw to the rest position. For example, a compound bow with a 30 inch draw length and a 7 inch brace height (distance from grip to the string at rest) has a 23 inch power stroke (30−7+23). A person using a 30 inch draw will shoot the same weight arrow faster than one using the same draw weight and arrow with a 28 inch power stroke. The same relationship exists with the crossbow—longer power stroke causes higher velocity.

The power stroke and draw weight variations have other effects beyond speed and energy. The most noticeable effect of the draw weight is the effort and techniques used to draw the bow. The heavy draw weight of the cross bow usually requires two-handed cocking using leg and back muscles to draw the string against a foot stirrup or bar. Some archers may not have enough strength for even that two-handed maneuver, and must rely upon a mechanical crank. This effectively limits a crossbow hunter to a single shot at game, since it is cumbersome to re-cock the cross bow and nock a bolt in a tree stand or cramped blind. On the other hand, a hunter can hold the loaded crossbow on an approaching target for an extended time while waiting for the range and cover to present an opportunity for a lethal shot, since there is no draw weight acting against the archer's muscles. De-cocking the crossbow is another difficult task, and many find it more convenient to simply fire the bolt into soft ground to de-cock.

The compound bow is the more accurate weapon in the hands of an experienced archer because of its consistent anchoring point when using string loop and mechanical release, which defines the nock point more consistently than does the crossbow latch, but the crossbow allows much faster mastery by beginners, as its aiming and trigger systems closely resemble a shoulder mounted firearm. The crossbow is also heavier than a compound bow, and less maneuverable in brush or tree branches.

Considering that the main advantage of the crossbow is its ability to draw and lock it at full draw until ready to shoot, it is not surprising that innovators have devised mechanisms to lock a compound bow at full draw. A representative example of these draw-locking mechanisms is shown in U.S. Pat. No. 5,671,723 by the present inventor.

SUMMARY OF THE INVENTION

This invention relates to improvements in the butt stock and trigger/string release assemblies for the inline crossbows and the conversion kits that are described in the parent application. The term "crossbow" is used in this description at times to describe the traditional horizontal limb crossbow with short draw length, and at other times to describe the longer draw compound bow attached to a stock and draw-lock assembly, since many state hunting regulations classify any bow with a mechanical draw-lock as a crossbow. To avoid confusion over terminology, the term crossbow is used herein to mean any bow having a stock, such that the limbs and stock form the general shape of a cross, regardless of whether the limbs are oriented vertically or horizontally. The context in which the term crossbow is used in this description should allow the reader to distinguish between the traditional cross bow and the draw-locking compound bow whenever such distinction is appropriate. The crossbow will also have a string latch and release mechanism to hold the bow string at a drawn position and some type of trigger mechanism to release the string.

There were are two significant aspects of the invention in the parent application: (1) a kit for converting a compound bow into a left or right handed inline crossbow, and (2) a dedicated hybrid compound bow to use with the kit that eliminated some features of the traditional compound bow, and which can be used with the conversion kit equipment as an inline crossbow or a horizontal limb crossbow.

The present invention is directed to improvements in the trigger/string release assemblies and an improved butt stock. The parent application describes a draw-lock bar that simulates a forearm stock, with a pistol grip and a trigger-actuated string release at its butt end. The present invention provides an improvement wherein the trigger assembly is moved forward relative to the string latch/release assembly on opposite sides of the draw-lock bar. The trigger is connected to the string release by an actuator rod which may be inside of the draw-lock bar. In the preferred embodiment, the trigger and release assemblies can be attached to the draw-lock bar on either side, allowing for conversion between left or right handed configuration. The string latch has a sliding cover to allow the archer to put the release against his cheek without being stung by the string, and to protect the string from being pried off the latch by brush or other obstacles.

An improved butt stock can pivot inward to lie along the draw-lock bar over the string latch/release assembly. As in the parent application, the trigger assembly includes a safety, and the string release assembly includes an anti-dryfire lever which stops the string latch from releasing when there is no arrow nocked, even if the safety is off and the trigger is accidently pulled. Apart from those differences, the description contained in the patent application, which is largely repeated below, continues to be applicable to understanding the invention.

The draw-lock bar mounts into a receiver socket that is attached at an adjustable angle to a mounting plate at the compound bow's arrow rest screw taps. The bar can be quickly detached from the receiver socket to break down the bow/kit into two parts for compact storage. The bar can also be hinged in the middle to fold in half for storage. The bar is a hollow tube with square cross section, and has a series of holes spaced along its length to adjust the draw length. A compound bow can be mounted to the draw-lock bar in either right hand or left hand inline (vertical limbs) configuration, and the hybrid compound bow can be mounted as an inline or traditional crossbow (horizontal limbs) configuration.

The kit also provides a cocking stirrup attached to the draw-lock mounting plate in front of the draw lock socket. The stirrup has a pivoting hinge connection to the mounting plate so that the stirrup can be folded back 180 degrees to lie along the outside edge of the bar. When using the hybrid crossbow (horizontal limb) configuration the stirrup can also be stopped at a 90 degree position under the bar and used as a bipod rest, or stopped at 45 degrees under the bar as a kick-stand supporting the bow with the arrowhead angled upward. The kit also includes a vertical hand grip attached to the bow riser on the opposite side from the bar socket.

The hybrid compound bow of the invention is made specifically for use with the conversion kit. It has forward curving riser sections that locate the limb pockets well in front of the riser center point. The limbs extend backward from the pockets in an essentially parallel or slightly closing orientation, such that the axle to axle distance between the eccentric pulley wheels is very short, on the order of 18-19 inches. This provides a very compact compound bow with a power stroke that can be over 20 inches, depending of the draw bar length selected. With the aid of the cocking stirrup, even a 75-80 lb draw weight is easily handled by almost any adult. The hybrid bow does not itself have a handgrip, and thus is not a stand alone bow. The forward handle is provided by the vertical grip of the conversion kit. The lack of an integral handle, however, allows the bow to use a shoot-through riser with a contained arrow rest (such as a whisker biscuit) that locates the arrow exactly on vertical and horizontal center from the nocking point through the center cut-out in the biscuit. This exact centering improves accuracy by reducing arrow torque and string vibration, and is the most efficient location (the center) of the string for top speed and performance.

An added embodiment moves the rear pistol grip and the trigger/safety assembly forward along one side of the draw-lock bar, while keeping the string release and anti-dryfire lever assembly on the other side of the bar back at a draw near the archer's lip. This allows the archer to shoulder mount the bow to a consistent "lock-in" position, using a set contact point with his lip or cheek as the anchor point, while at the same time it moves his trigger hand forward to a comfortable position in front of his eyes and nose. Conceptually, this new arrangement is similar to the "bullpup" configuration kit for many rifles, which moves the trigger forward of the action to shorten overall length. In the context of a crossbow, however, the reason for moving the trigger further ahead of the string release is not to shorten the weapon itself, but rather to preserve the long draw-length and anchor point while making the weapon easier to balance and sight align. A sliding cover provided for the string release allows the archer to press the anchor point against his lip or cheek without being stung when the string releases. The sliding cover also keeps the string loop from being accidently pried off of the release lever. The cover slides backward to draw and latch the string, then forward to cover the latch.

The butt stock is also improved over the minimalist rear flange shown in FIG. 8. The improved butt stock is a thin aluminum band shaped to a butt stock profile with its heel at a slight elevation above the draw bar and its toe located slightly below the bottom of the pistol grip. The ends of the band attach to the draw-lock bar by a pivot bolt that allows the stock to swivel in against the bar to shorten the assembly for travel and storage, and to protect the sliding cover for the string release.

The new features of the invention are presented in FIGS. 12 through 17 and the description of those figures. Features that are not changed are described in the earlier figures and some of those may be relevant to the invention.

These and other features, aspects and advantages of the present invention will become better understood with reference to the following drawings, description and claims.

DETAILED DESCRIPTION

Figure 1:
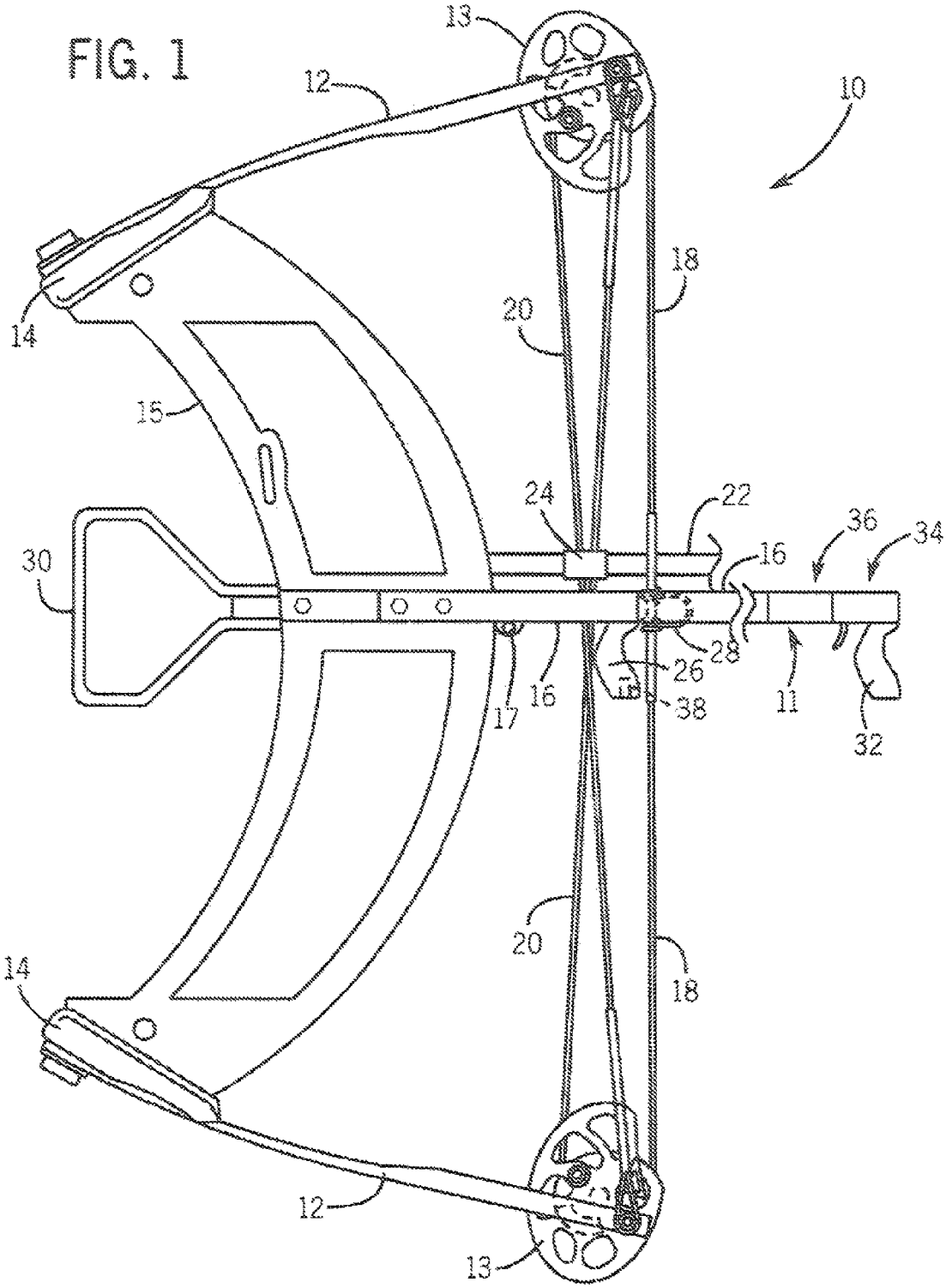
FIG. 1 is a left side elevation view of a hybrid archery bow mounted on the draw-lock bar of a conversion kit for right-handed inline shooting. The front-end vertical grip of the kit is not shown in this drawing.
Figure 2:
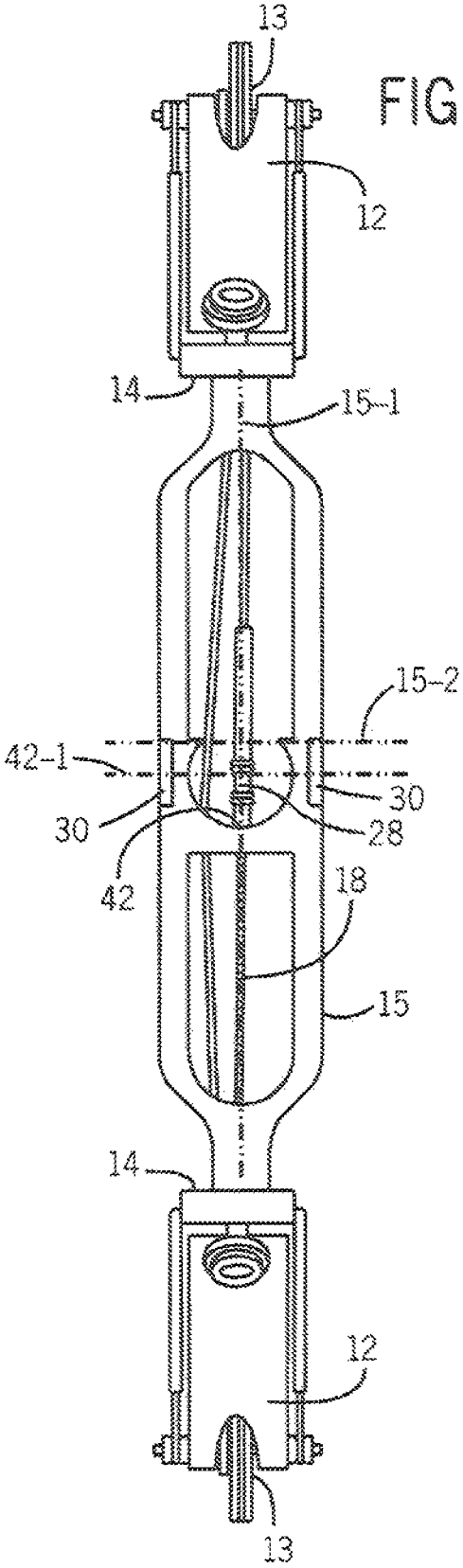
FIG. 2 is a front elevation view of the riser section of a hybrid bow as in FIG. 1 without being mounted on the conversion kit.
Figure 3:
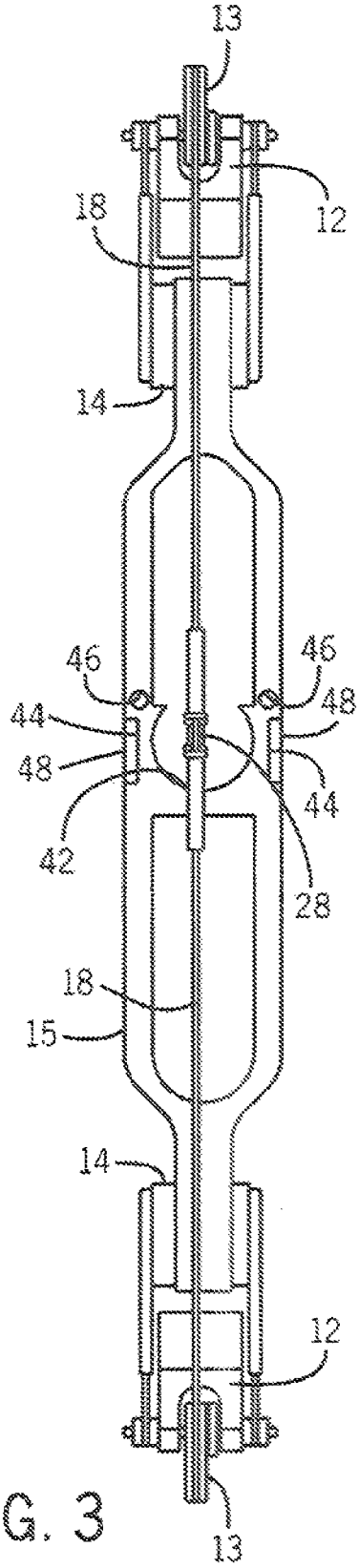
FIG. 3 is a rear elevation view of the riser section of a hybrid bow as in FIG. 2.

The following description is of exemplary embodiments of the invention. The scope of the invention is defined by the appended claims. Various features are described that can be used independently of one another or in combination with other features.

The invention will be described below with reference to a conversion kit in combination with a hybrid compound bow. It should be apparent from this description that the same kit can be used to convert a traditional compound bow to a crossbow in a similar manner, although an explanation of the differences will be provided at times where appropriate. Both the hybrid bow and a traditional compound bow can be mounted to the draw-lock bar with limbs oriented vertically in either a left or right hand configuration. The hybrid bow can additionally be mounted to the draw-lock bar with limbs oriented horizontally (traditional crossbow orientation).

The legend to assist in identifying number items in the drawings that was found in the parent application has been omitted from this application to save space, since the elements corresponding to the drawing numbers should be apparent from the text of this application.

FIGS. 1 through 4 show the combination 10 of a hybrid bow 11 and conversion kit to make it useable as an inline crossbow or a traditional crossbow, depending upon the limb orientation. The hybrid bow is specifically adapted for use with this conversion kit. It has most of the features of a traditional compound bow, such as limbs 12 extending from adjustable angle limb pockets 14 to tips with eccentric cable pulleys 13. The bow has forward curving riser sections (15 is the combined upper and lower sections of the riser) that locate the limb pockets well in front of the risers' center point. The limbs extend back from the pockets in an essentially parallel or slightly closing orientation, such that the axle to axle distance between the eccentric pulley wheels is very short, on the order of 18-19 inches at rest. This provides a very compact compound bow, but with a power stroke that can still be over 20 inches, depending of the draw length selected with the conversion kit. The hybrid bow also has other normal compound bow elements, such as a bow string 18 (including a draw loop 28) attached to cables 20, a cable guard 22 and a cable slide 24.

Because it is specifically designed for use with the conversion kit, the hybrid bow's riser 15 is a shoot-through riser 15 where the riser sections are split to allow the arrow to pass through the riser rather than along a side of it. This split riser configuration is well known and found on several traditional compound bows. The riser has a circular cut-out for a contained type of arrow rest that envelops and constrains the arrow centered on the rest even when the bow is canted, such as the Whisker Biscuit by Trophy Ridge Archery or the Catawba Still Shot rest. This cutout places the arrow slot in the rest at the horizontal centerline of the riser, and thus allows the alignment of the nocking point on the string with the center of the arrow rest to position the arrow in the plane of the horizontal centerline of the how. This allows the string 18 to be approximately aligned with the vertical center line 15-1 (see FIG. 2) and the horizontal center of the riser. Thus, the arrow has both vertical and horizontal centering on the bow, whether the limbs are positioned vertically or horizontally.

Note that the hybrid bow does not have a forehand grip at the riser. This hybrid bow is dedicated to be used with the conversion kit, which supplies a vertical forehand grip 26 to be attached on the side opposite to the draw-lock bar assembly to accommodate right or left hand shooting.

Figure 4:
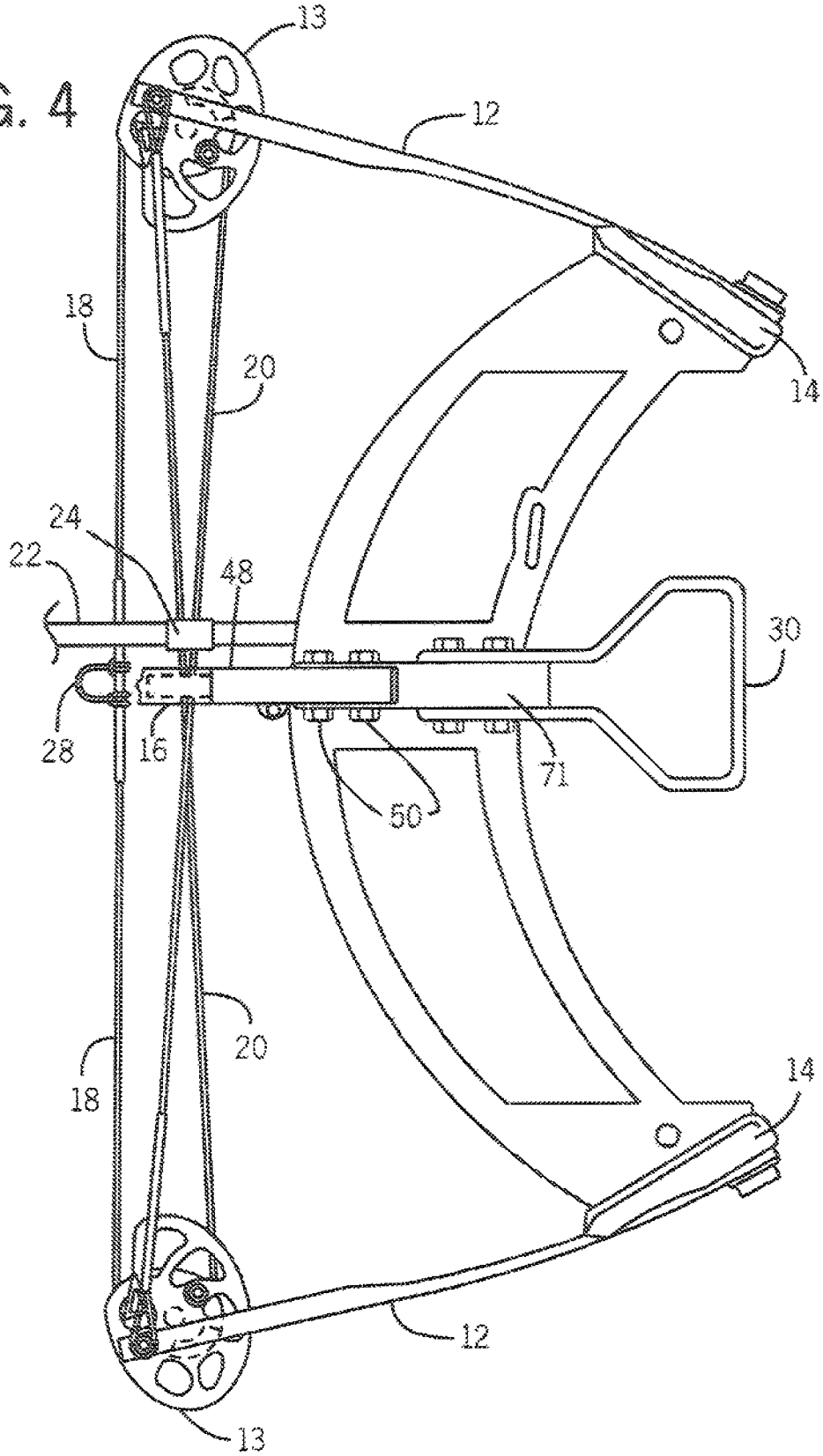
FIG. 4 is a right side elevation view of the hybrid bow mounted to a conversion as in FIG. 1.
Figure 13:
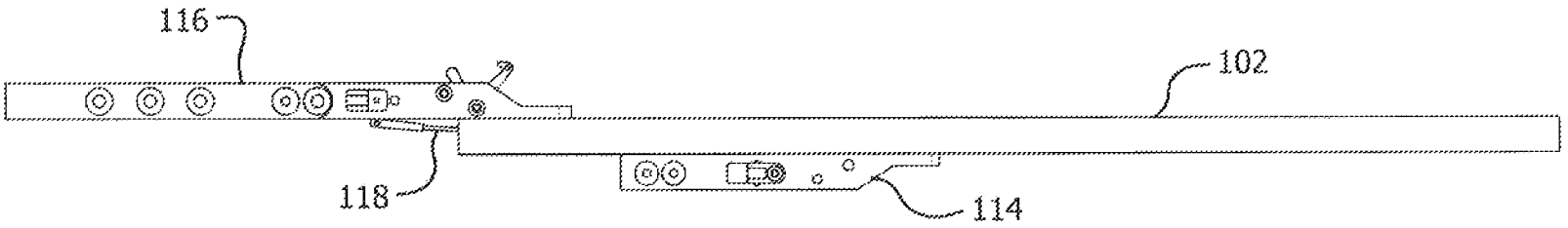
FIG. 13 is a top view of a draw-lock bar having trigger and string release assemblies as shown in FIG. 12. The trigger is on the underside of the trigger assembly and not visible in this drawing.

Both sides of the riser on the hybrid bow have a mounting plate 44 for mounting elements of the conversion kit to the bow. As shown in FIG. 13, the mounting plates can be made integral into the hybrid bow, or can be separate plates supplied in the kit to be used with a traditional compound bow. As shown in FIG. 4, when configured for right hand shooting, a square-profile hollow tube socket 48 is attached to the right side mounting plate 71 by bolts 50. The socket 48 receives the distal end of the draw-lock bar 16. The socket can be attached to the mounting plate at an adjustable angle by the bolts 50 passing through a fixed hole and an elongated slot, as shown in FIG. 11.

Figure 11:
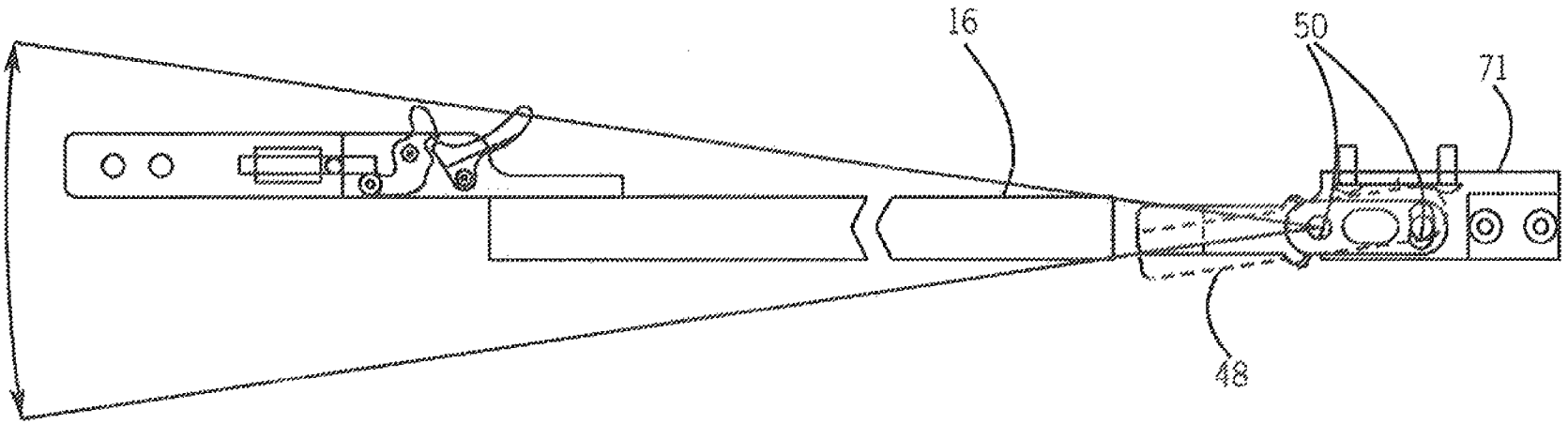
FIG. 11 is a side elevation view of the two mounting plates for use with a conventional compound bow.

The mounting plates for a traditional compound bow are shown in FIG. 11. The mounting plate to which the draw-lock socket is attached has a bolt hole and a bolt slot. The slot allows the socket to be adjusted to set the bar at a small angle set-off from the bow centerline so that it does not interfere with the cables and draw string. By making this offset angle with the socket, there is no need to bend the bar. The bar remains straight no matter whether it is mounted on the left or right side of the bow.

Figure 9:
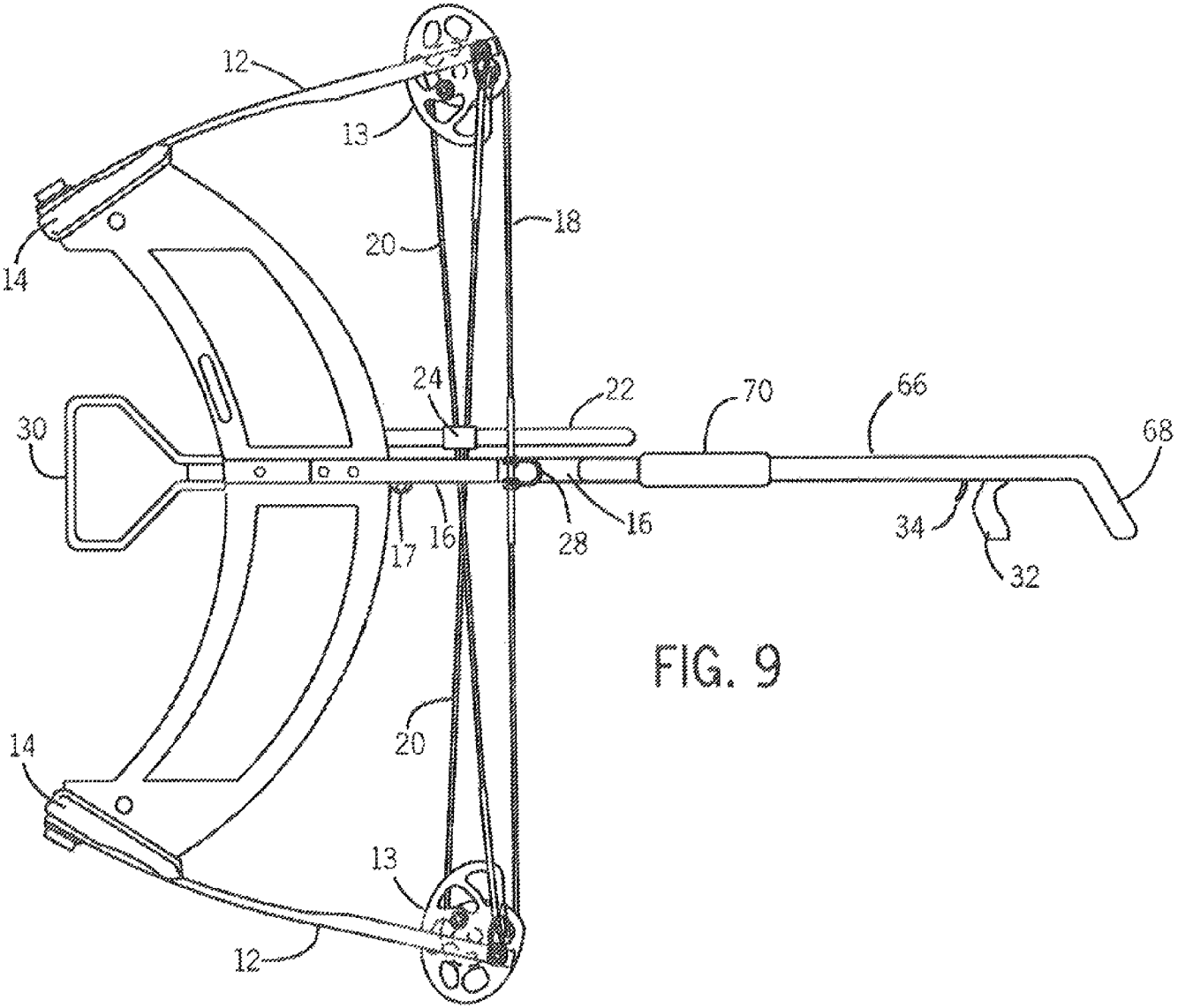
FIG. 9 is a left side elevation view of a hybrid archery bow hybrid archery bow mounted on a alternative conversion kit, wherein the draw-lock bar includes a butt stock and a forearm stock.
Figure 10:
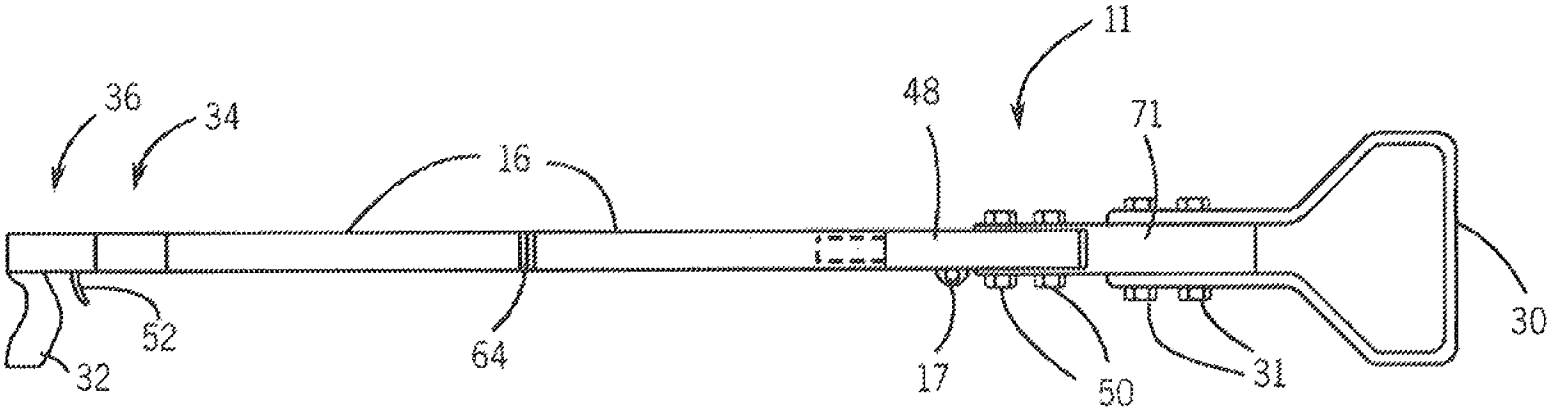
FIG. 10 is a side elevation view of the two mounting plates for use on the hybrid bow.

The draw-lock bar 16 that is inserted into the socket 48 simulates a forearm stock, having a pistol grip and trigger-actuated string release at the butt end. The trigger assembly has a regular crossbar safety 54 behind the trigger 52, and an anti-dryfire lever 62 that stops the string release latch 60 from moving enough to release the string loop if there is no arrow on the string, even if the trigger is accidently pulled. The draw bar can optionally be extended to terminate in a butt stock 68 for shoulder mounting (as shown in FIG. 9), but since the bow does not produce a rearward recoil to be absorbed by the shoulder, there is no need for any shoulder contact.

Figure 5:
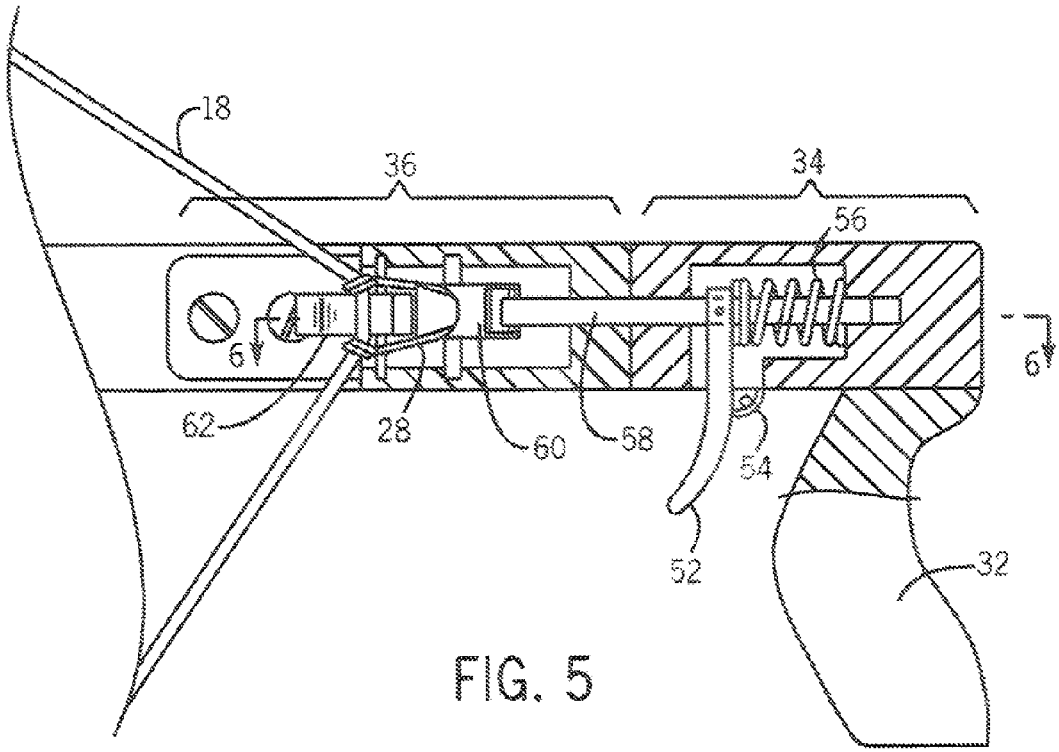
FIG. 5 is a right side elevation view of the string latch and release assembly of the conversion kit, with parts broken away along the housing and pistol grip to view the string release and trigger mechanism.
Figure 6:
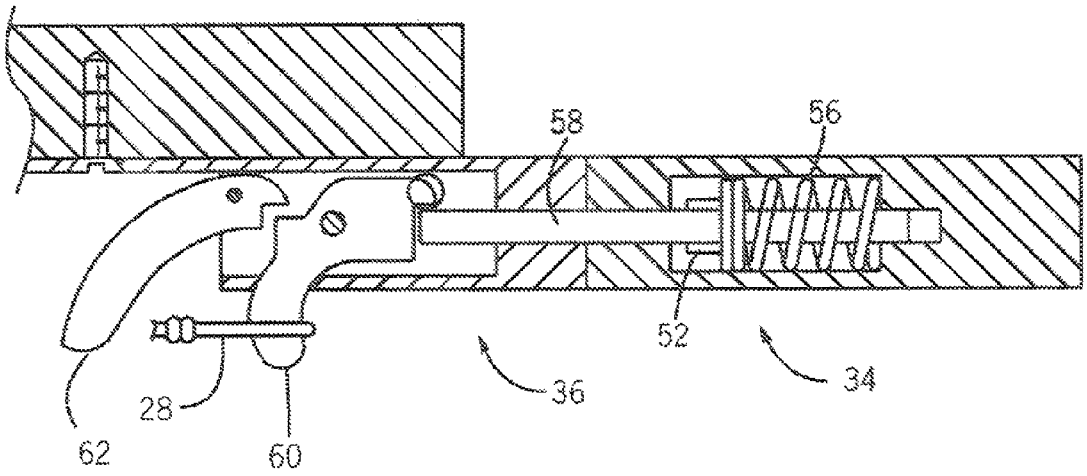
FIG. 6 is a top cross-sectional view taken on line 6-6 of FIG. 5 to show the string latch, anti-dryfire lever, and trigger mechanism.
Figure 7:
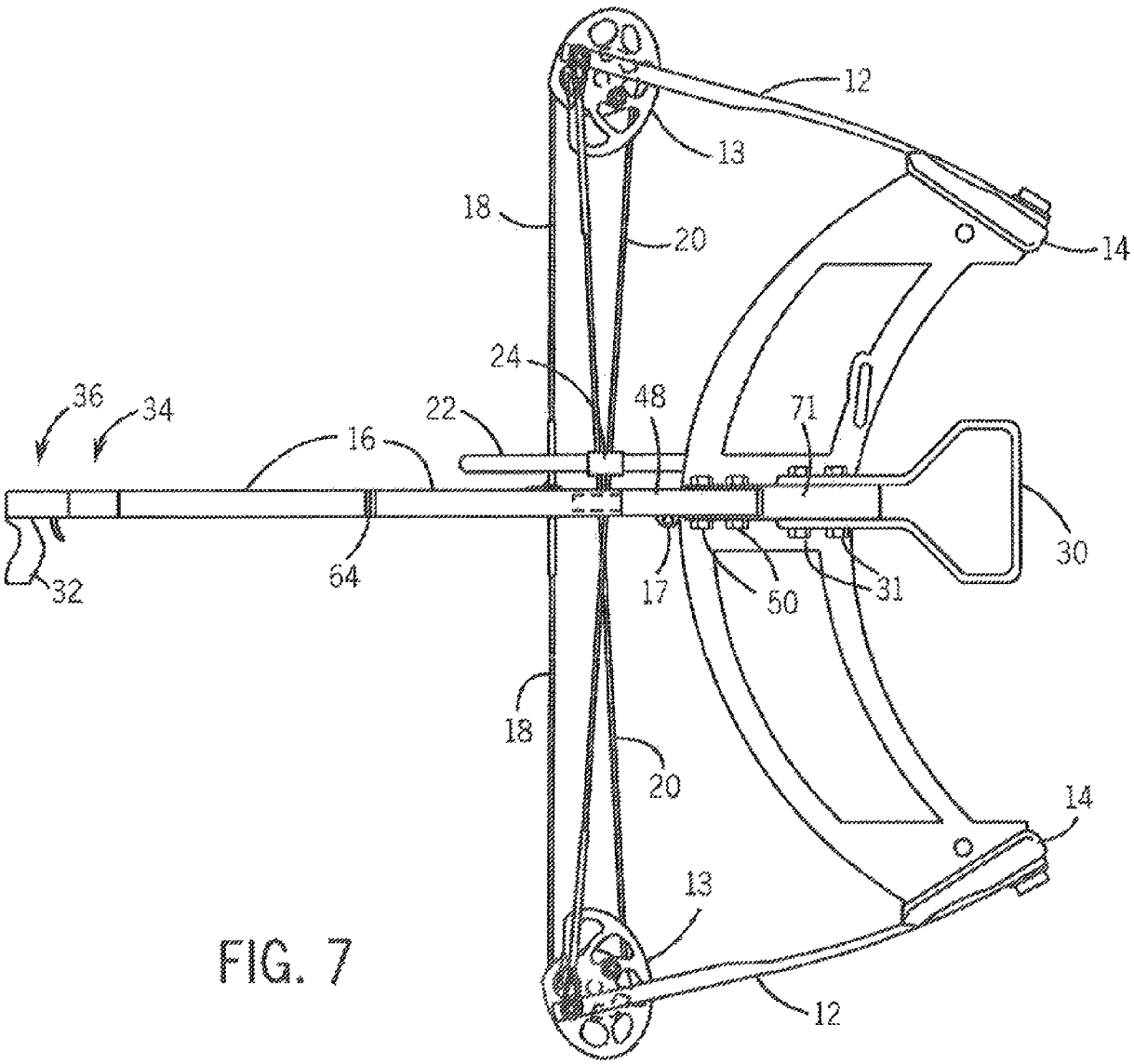
FIG. 7 is a right side elevation view of the hybrid archery bow archery bow mounted on an alternative draw-lock bar, similar to FIG. 4, except having a hinge at the mid-point of the draw-lock bar for breakdown and storage.
Figure 8:
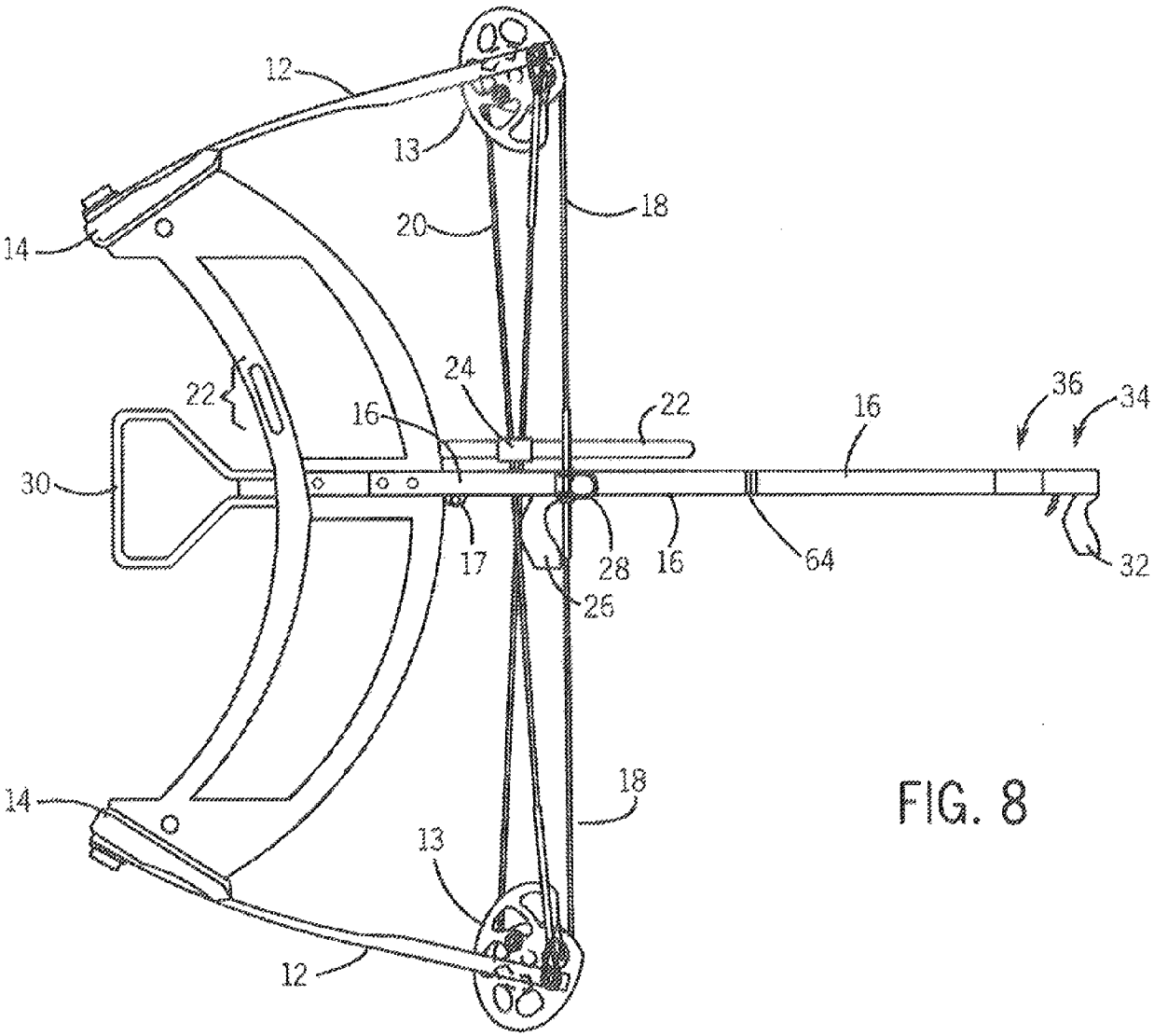
FIG. 8 is a left side elevation view of the hybrid archery mounted on a draw-lock bar as in FIG. 7.

The draw lock bar 16 has a series of bolt holes 36 at least near the trigger grip end that are spaced at about one inch between centers. These holes are used to attach the grip and trigger assembly to the bar at a selected length to adjust the distance between the string latch and the bow string at rest (adjusting draw length). The string latch is part of the pistol grip and trigger assembly (as shown in FIGS. 5 and 6), which comprises a pistol grip 32, a trigger section 34, a safety, a string latch 60, and an anti-dryfire lever 62. The grip and trigger assembly attach to the bar by bolts using the adjustable length draw length holes 36 to select the draw length.

Figure 14:
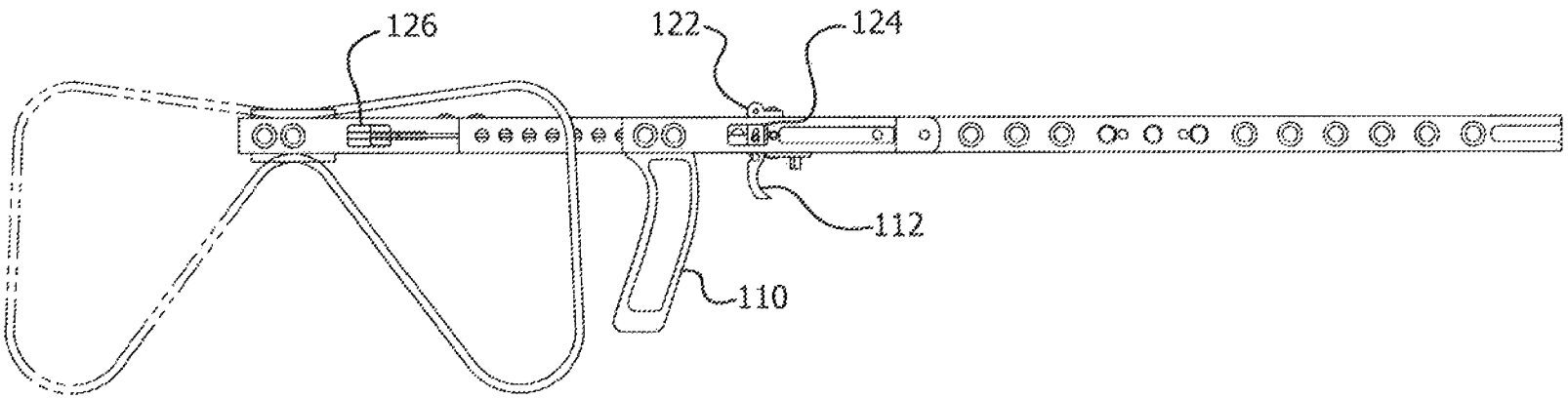
FIG. 14 a left side elevation view of a draw-jock bar as in FIG. 12 with the butt stock swiveled against the bar.
Figure 15:
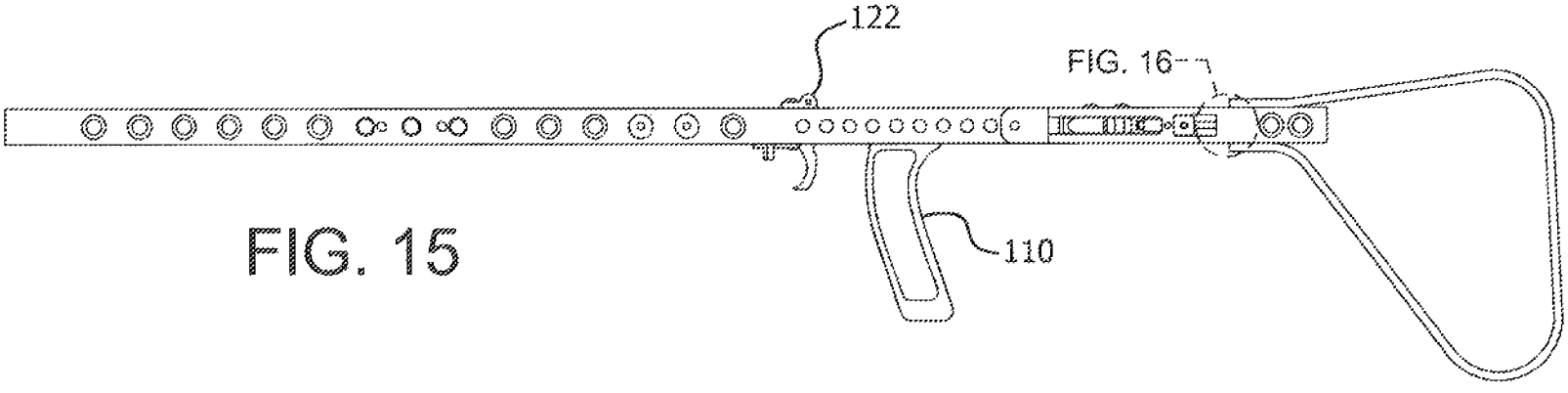
FIG. 15 is a left side elevation view of a draw-lock bar having an alternative butt stock and the trigger and string release assemblies as in FIG. 12 in accordance with the invention
Figure 16:
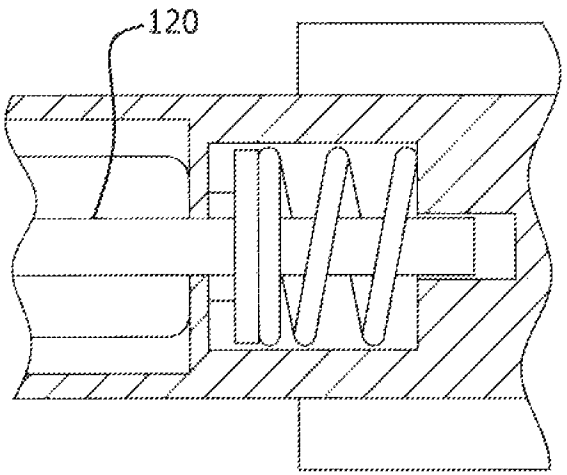
FIG. 16 is a close-up view of the area identified as area C if FIG. 15.
Figure 17:
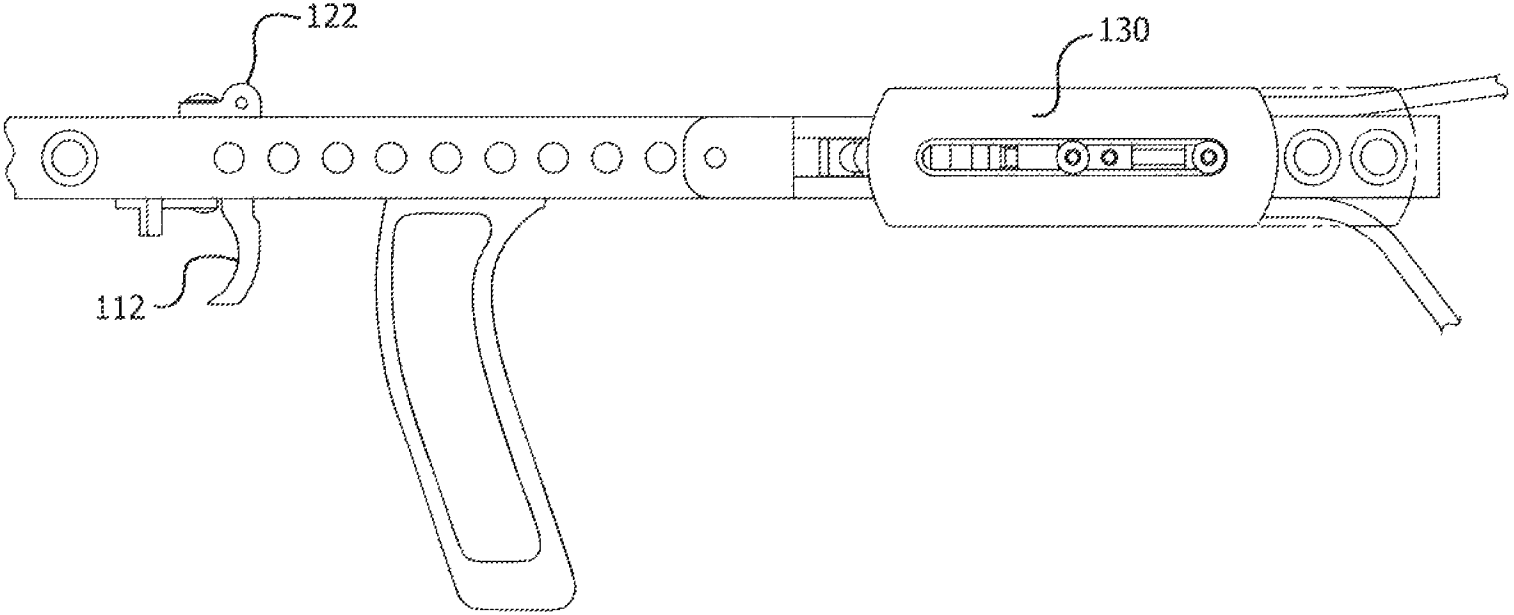
FIG. 17 is a close up of a section of the bar-lock bar as in FIG. 12 showing the sliding cover for the string latch.

Note that the pistol grip and trigger assembly can be individually located on either side of the draw-lock bar for right or left hand shooting. As shown in FIG. 5, the assembly is always bolted to the inside (side facing the bow string) side of the bar, placing the string latch 60 and anti-dryfire lever in a line with the string and arrow rest. If the bow were configured to be shot left handed, the draw-lock bar wound be attached to the mounting plate on the left side of the riser, and the pistol grip and trigger assembly again attached to the inside side of the bar. To place the trigger and grip in the proper downward extending orientation, bolts holding the grip and trigger can be removed (see FIG. 14), the grip and trigger rotated 180 degrees and the bolts replaced to hold them in place. Note that the grip and trigger could also be placed in a horizontal position for either left or right handed shooting by only rotating the grip and trigger 90 degrees. Some archers may like this horizontal trigger position. The two trigger bolts can also attach a scope mounting bracket (not shown).

At the front end of the bow, the conversion kit provides a foot stirrup 30 that is attached to the mounting plate 71 on the side having the socket for the draw-Jock bar. The stirrup mount is hinged, so that it can be extended in front of the riser for cocking the bow, folded back 180 degree along the bow to be stored out of the way, stopped at 45 degrees as kickstand for resting the bow on the ground or a platform in an inline configuration, or folded 90 degrees downward to act as a bipod shooting rest when using the horizontal limb configuration.

Using his foot in the stirrup, an archer can draw the string with two hands and hook the string release loop 28 over the release latch 60 (See FIGS. 5 and 6). The anti-dryfire lever 62 is a curved piece with a pawl bit formed on one end to engage with a catch on the string release 60. The opposite end of the anti-dryfire lever extends above the draw-lock bar just in front of the release. When an arrow is nocked, the shaft displaces the anti-dryfire level such that the pawl bit can not engage the catch on the string release. When the trigger is actuated, it will allow the string loop to push down the latch. If no arrow is nocked, however, the pawl will engage the catch when the trigger is pulled and hold the release against the pressure of the string loop.

As shown in FIG. 6, the trigger 60 is kept from rotating by a roller release 61 that is blocked from turning by a trigger pin 58. The trigger pin is pushed forward by the trigger spring 56. As the trigger is drawn back against the spring pressure, the pin travels behind the center point of the roller release, and allows the roller to tumble. The tumbling roller allows the string latch to pivot and release the string loop. This gives the sensation of a trigger with a short creep followed by a crisp break. Other types of triggers can be used, however. A conventional crossbar safety 54 is used to prevent accidental firing when an arrow is nocked. When an arrow (not shown) is knocked onto the string, the arrow shaft w displaces the anti dryfire lever from blocking the release latch.

The hunter can mount the hybrid bow 10 by holding the forward vertical grip 26 and the pistol grip 32. When a target is sighted, the hunter can follow its movement with the mounted bow until a good shot opportunity presents, then push the cross bar safety to the firing position, acquire a final sight picture and squeeze the trigger backward against the pressure of the trigger spring 56 until the roller release allows the string latch to rotate and release the string loop.

The conversion kit can also be used to mount the hybrid compound bow to the draw lock bar with its limbs horizontal to the ground like a traditional cross bow. The bow is held in the horizontal orientation when the draw lock bar is inserted into the socket. The trigger and grip can be individually relocated on the trigger assembly for left, right or horizontal shooting by removing the bolts and moving the trigger and grip either 90 degrees or 180 degrees to the appropriate holes and slot. The two grip bolts can be used to attach a scope mounting bracket.

Figure 12:
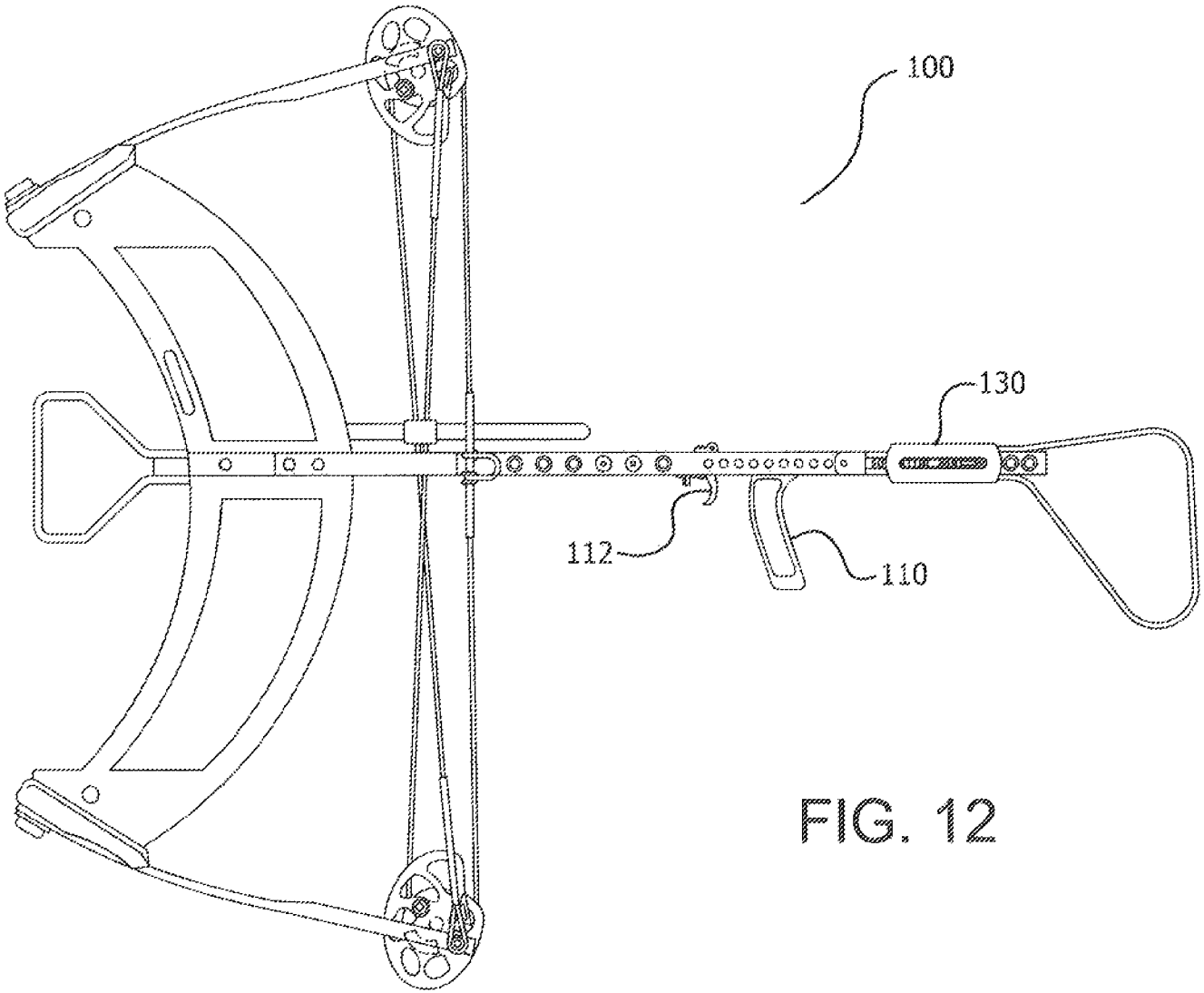
FIG. 12 is a left side elevation view showing a hybrid archery bow mounted on the draw-lock bar having an alternative butt stock, and improved trigger and string release assemblies in accordance with the invention.

New Configuration—Trigger Assembly and String Latch/Release Assembly, Improved Butt Stock and Sliding Cover for String Latch FIG. 12 shows a vertical limb (inline) crossbow 100 made from a compound bow with a conversion kit similar to that of FIG. 1, except that the trigger assembly is mover well foreword of string latch and release assembly. In the preferred embodiment, both the trigger assembly and the string latch and release assembly are adaptable to be connected to opposite sides of the draw-lock bar, and therefore can be switched from one side of the bar to the other to accommodate right or left hand configuration. It is possible, however, to make alternative embodiments. One such alternative is a crossbow/kit in which the trigger assembly is built into or attached to the bottom side of the draw-lock bar and only the string and latch assembly is moved to right or left side. Another alternative is to make dedicated right and left hand crossbows wherein the trigger assembly and string latch and release assemblies are fixed in place On the draw-lock bar.

Referring to FIG. 13, the pistol grip 110 and the trigger 112 (not visible from this top view) are located in a trigger housing 114 that attaches to a side of the draw-lock bar 102. On the opposite side of the bar the string latch and release are in a string latch housing 116, much as they were in the previous embodiments. The significant difference between this embodiment and the previous embodiments is that the trigger housing 114 is now located well forward of the string latch housing 116. This new configuration moves the rear pistol grip 110 and trigger 112 forward along the draw-lock bar, while keeping the string release near the archer's lip. This allows the archer to shoulder mount the bow to a consistent position, using his lip or cheek as the anchor point, while at the same time it moves his trigger hand forward to a comfortable position in front of his eyes and nose.

To reposition the trigger forward relative to the string release, the new embodiment includes an actuator rod 118 that provides a mechanical connection between the trigger 112 and the spring biased trigger pin 120. The trigger itself is a lever with a top end that extends through a slot in the top side of the trigger housing, where it is connected to a trigger rotation pin 122 that extends between a saddle/pin connector. The finger profile section of the trigger lever extends below the draw-lock bar.

In the depicted embodiment, the trigger also has a slider slot on an intermediate side, through which a connection post 124 is attached to the trigger. The post 124 extends from the trigger through one of the apertures in a side of the draw-lock bar (there are several such apertures spaced along the sides of the bar to allow trigger position to be adjustable). The front end of the actuator rod 118 attaches to the trigger connection post 124 inside of the draw-lock bar. The rear end of the actuator rod 118 has a fitting that attaches to a bushing block connector 126 that can slide fore and aft in slots on opposing sides of the string latch/release housing 116. The string latch lever has a latch hook portion for holding the drawn bow string, and a roller sear for interacting with the spring biased trigger pin. The trigger pin is connected with the actuator rod so that rearward movement of the actuator rod causes commensurate movement of the trigger pin, wherein movement of the pin to a release point at the roller sear allows the latch lever to pivot and release the string. The spring biased trigger pin 120 passes through the center of the bushing connector in a tight fit (preferable clamped there by a set screw), so that rearward movement of the actuator rod causes commensurate rearward movement of the trigger pin against the spring. The interaction of the bushing block with the slots in the sides of the trigger housing made the rearward movement essentially linear and torque free, despite the extended distance between the trigger and the trigger pin. This provides the same or better smooth trigger pull and crisp release as in the earlier embodiments.

In alternative embodiments (not depicted), the trigger could attach to the actuator rod in others ways besides the post connection described above. And a trigger pressure spring could be added inside the trigger housing in addition to or in substitution of the trigger spring in the string release housing.

With the trigger repositioned well forward relative to the string release, the archer will be able lock into a stable aiming stance by pressing his cheek against the string release to establish a consistent anchor point and aiming position. A sliding cover 130 for the string release allows the archer to press his lip or cheek over the release without being stung when the string releases. The sliding cover also keeps the string from being accidently pulled off of the release lever by brush or other obstacles that might catch the string. The cover is mounted on pins and slides easily backward to draw and latch the string, then forward to cover it.

The improved butt stock 140 is a thin aluminum band shaped to a butt stock profile with its heel at a slight elevation above the draw-lock bar and its toe located slightly below the bottom of the pistol grip. The ends of the band attach to the draw-lock bar by a pivot bolt connection that allows the stock to swivel in against the bar to shorten the assembly for travel and storage, and to protect the sliding cover for the string release.

The foregoing description relates to exemplary embodiments of the invention. Modifications may be made without departing from the spirit and scope of the invention as set forth in the following claims.

We claim:

1. A crossbow comprising:

an archery bow attached to a draw-lock bar, the draw-lock bar having a trigger assembly and a string latch and release assembly, wherein the trigger assembly is located forward of the string latch and release assembly, and the string latch and release assembly is adaptable to be connected to opposite sides of the draw-lock bar to convert between right and left hand configurations.

2. A crossbow as in claim 1, wherein both the trigger assembly and the string latch and release assembly are adaptable to be connected to opposite sides of the draw-lock bar to convert between right and left hand configurations.

3. A crossbow as in claim 2, wherein an actuator rod connects the trigger assembly to the string latch and release assembly.

4. A crossbow as in claim 3, wherein the actuator rod is located in the draw-lock bar.

5. A crossbow as in claim 2, wherein the trigger assembly includes a trigger lever connected to a trigger rotation pin located on a top side of the housing, the trigger lever having a finger profile extending below a bottom side of the trigger housing.

6. A crossbow as in claim 2, wherein the string latch and release assembly includes a string latch lever having a latch portion for holding a drawn bow string and a roller sear for interacting with a spring biased trigger pin, the trigger pin being connected with an actuator rod so that rearward movement of the actuator rod causes commensurate movement of the trigger pin, wherein movement of the pin to a release position at the roller sear allows the latch lever to pivot and release the string.

7. A cross bow as in claim 2, further comprising a sliding cover mounted adjacent the string latch assembly and capable of being slid to an open position uncovering the latch and a closed position covering the latch.

8. A crossbow as in claim 7, having a butt stock attached to an end of the draw-lock bar opposite the bow, the stock being pivotally attached to the bar such that the stock can be pivoted to lie along the bar over the string latch and release assembly.

9. A crossbow as in claim 1, wherein an actuator rod connects the trigger assembly to the string latch and release assembly.

10. A kit for converting a compound bow into an inline crossbow, comprising:

a draw-lock bar having at one end a mechanism for attaching a compound bow to either right or left hand sides of the bar, the draw-lock bar having near its opposite end a trigger assembly and a string latch and release assembly, each assembly adapted to be connected to opposite sides of the draw-lock bar, wherein the trigger assembly is located forward of the string latch and release assembly.

11. A kit as in claim 10, wherein an actuator rod connects the trigger assembly to the string latch and release assembly.

12. A kit in claim 11, wherein the actuator rod is located within the draw-lock bar.

13. A kit as in claim 10, wherein the trigger assembly and the string latch and release assembly can be connected to either side of the bar such that the crossbow can be configured for right hand or left hand operation.

14. A kit as in claim 10, wherein the string latch and release assembly includes:

a string latch lever have a latch portion for holding a drawn bow string and a roller sear for interacting with a spring biased trigger pin, the trigger pin being connected with an actuator rod so that rearward movement of the actuator rod causes commensurate movement of the trigger pin, wherein movement of the pin to a release point at the roller sear allows the latch lever to pivot and release the string.

15. A kit as in claim 14, further comprising a sliding cover mounted adjacent the string latch and capable of being slid to an open position uncovering the latch and a closed position covering the latch.

16. A kit as in claim 15, further comprising a butt stock attached to an end of the draw-lock bar opposite the bow, the stock being pivotally attached to the bar such that the stock can be pivoted to lie along the bar over the string latch and release assembly.

* * * * *